US005213356A

United States Patent [19]

Rohrmoser

[11] Patent Number: 5,213,356

[45] Date of Patent: May 25, 1993

[54] COUPLING DEVICE FOR A SKI

[75] Inventor: Alois Rohrmoser, Wagrain, Austria

[73] Assignee: Varpat Patentverwertungs AG, Littau, Switzerland

[21] Appl. No.: 809,019

[22] Filed: Dec. 17, 1991

[30] Foreign Application Priority Data

Dec. 21, 1990 [AT] Austria ..... 2631/90

[51] Int. Cl.[5] ..... A63C 9/081

[52] U.S. Cl. ..... 280/607; 280/618

[58] Field of Search ..... 280/617, 618, 623, 625, 280/626, 616, 620, 629, 630, 633, 636, 607

[56] References Cited

U.S. PATENT DOCUMENTS

| | | | |
|---|---|---|---|
| 4,192,527 | 3/1980 | Replogle | 280/618 |
| 4,274,653 | 6/1981 | Himmetsberger et al. | 280/618 |
| 4,277,083 | 7/1981 | Himmetsberger et al. | 280/618 |
| 4,679,815 | 7/1987 | Pascal et al. | 280/618 |
| 4,709,942 | 12/1987 | Dimier et al. | 280/618 |

FOREIGN PATENT DOCUMENTS 4005495 8/1990 Fed. Rep. of Germany .

*Primary Examiner*—Richard M. Camby

*Attorney, Agent, or Firm*—Collard & Roe

[57] ABSTRACT

A coupling device between a ski boot and a ski having a top surface and a toe binding. The toe binding engages the ski boot and is pivotal around a first axis which is perpendicular to the top surface of the ski. The coupling device also includes a heel binding for engaging the ski boot. A carrier device having a front end, a back end and two sides, is located between the toe binding and the heel binding for supporting the ski boot. The carrier device is pivotal around a second and third axis which are arranged along the back end of the carrier device and are parallel to the first axis. Also, connection means are provided for operatively connecting the toe binding to the front end of the carrier device so that the carrier device can pivot around one of the axes jointly with the toe binding pivoting around the first axis.

28 Claims, 4 Drawing Sheets

COUPLING DEVICE FOR A SKI

BACKGROUND OF THE INVENTION

The invention relates to a coupling device between a ski boot and a ski. More particularly, it relates to a coupling device with a low friction contact between the ski boot and the ski.

DESCRIPTION OF THE PRIOR ART

The prior art according to DE-OS 40 05 495 of the same applicant shows a coupling device for a ski formed by a toe binding and a heel binding which are connected by a connection element. The connection element is attached to the toe binding and/or heel binding in an articulated manner by a pivot lever and is designed to move with the toe and/or heel binding. When torque is applied to the skier's leg and boot, the toe binding pivots around an axis which is perpendicular to the surface of the ski. If the torque is sufficient to release the ski boot, the connection element and heel binding pivot around an axis located near the heel binding, in the case of the connection element being connected to the heel binding. When the toe and heel bindings pivot in opposite directions around two different axes, the distance between the toe and heel bindings is reduced. Therefore, the forces required to release the ski binding briefly exceed the preset values. This has to be taken into consideration when adjusting such a binding, by application of a correction factor.

SUMMARY OF THE INVENTION

It is, therefore, an object of the present invention to eliminate the aforementioned drawbacks of the prior art and to provide a coupling device in which almost no friction occurs between the ski boot and contact surfaces of the binding parts during release.

It is a further object of the present invention to provide such a device which does not require a correction factor to account for the increased force necessary to release the ski boot due to friction of the binding.

It is yet another object of the present invention to provide such a coupling device which can be adjusted to accommodate different sized ski boots.

These and other related objects are attained according to the invention by a ski coupling device between a ski boot and a ski having a toe binding and a heel binding. A carrier device extends from the toe binding toward the heel binding and terminates at a pair of pivot points. When a torque is exerted on the ski boot, the carrier device pivots along with the boot to eliminate friction between the bottom of the boot and the coupling device. Surprisingly, it was found that a superior result is achieved by the carrier device extending only part of the distance between the toe and heel bindings. This arrangement is contrasted with a pivot point arranged at the heel binding along the longitudinal center axis of the ski. The carrier device has a pair of pivot polnts which are located on either side of the longitudinal center axis. The carrier plate pivots in a direction transverse to the longitudinal center axis on the pivot point located on that side of the longitudinal center axis. Due to the kinematics of this arrangement, the relative movement which occurs during pivoting between the sole of the ski boot and the support device locate on the carrier device near the toe binding does not affect the force required to release the boot. Thus, no friction occurs between the sole and the carrier device to increase the release force. As a result, ideal release characteristics can be realized. At the beginning of the pivot movement, the required release force increases up to a predefined point, in order to absorb short-wave impacts in this range, without release of the binding. If the deflection excess this range, i.e. due to greater stress, which would cause injury to the foot of the skier, rapid release of the binding occurs without undefined stress peaks.

In a further embodiment, connection means are provided between the toe binding and the front end of the carrier device so that the carrier device can pivot around one of its axes jointly with the toe binding pivoting around its axis. The carrier device is advantageously held in place by a pin which extends up through a sliding track in the carrier device. The pin, which is attached to the ski, slides along the sliding track as the carrier device is pivoted around the support points. Also, the pin may be attached to the carrier device and slide along a track formed in the ski.

Alternatingly, a guide track may be formed in the carrier device in the vicinity of the pivoting toe binding which engages the ski boot. This arrangement results in a length equalization between the pivot points of the pivoting coupling device parts which are arranged opposite each other, such as the carrier device and the toe binding. The toe binding may be provided with a cog which extends into the guide track of the carrier device. In the rest position, the guide track extends along the longitudinal center axis of the ski with the cog in the track. This configuration makes it possible to eliminate additional guide elements, especially guide levers, between the cog and the toe binding and the carrier device.

When the toe binding pivots, the cog moves off the longitudinal center axis sliding along the guide track, causing the carrier plate to pivot so that the guide track is no longer aligned with the longitudinal center axis. Alternatively, the carrier plate may be provided with a cog which extends into a guide track integrated into the toe binding, which is advantageously and easily produced using a pressure molding or injection molding process, by a corresponding structure of the die.

In a further preferred embodiment, the carrier device may be provided with projections which point toward the heel binding and engage with V-shaped recesses of a counter-holder. The cone angle of the recesses is greater than the point angle of the projections so that the carrier device can alternately pivot from the center position in either direction without additional guide elements.

In yet another embodiment, the counter-holder and the pin or the sliding track can be part of the connection element which connects the toe binding and heel binding. This structure causes the carrier device to be fixed in its position relative to the toe and/or heel bindings. Thus, the coupling device can be adjusted in its position relative to the ski and in its longitudinal direction without additional adjustment elements.

Advantageously, the sliding track of the carrier device extends from a point on the longitudinal center axis along two arcs towards each of the projections. The center point of each arc is approximately the opposite projection. Accordingly, an exact pivot movement around the rotation point formed by each projection is achieved.

Preferably, the carrier plate is provided with a standing plate which engages the ski boot. The carrier plate is made of a ow friction material, for example a plastic or polytetraflouroethylene. This simplifies release of the boot from the coupling device.

According to another advantageous embodiment, the counter-holder is connected to a base plate or a housing of the toe binding. This results in a wide adjustment range for various sizes of ski boots, without additional settings for subsequent adjustment of the coupling device. The counter-holder and pin or the sliding track may be part of the connection element which makes it possible to retrofit existing bindings with the pivoting carrier device. The counter-holder can move in the longitudinal direction along with the connection element and is provided with a locking device which can be released, if necessary. This allows a distance change between the toe and heel bindings by changing their position relative to the connection element.

Alternatively, the carrier device can be provided with two sliding tracks on either side of the longitudinal center axis, each with a pin extending up, forming a pivot point. Each sliding track forms an arc with the center point being the opposite pin. Thus, the counter-holder and the finger-like projections can be eliminated.

The carrier device is ideally approximately 60% of the distance between the toe binding and the heel binding for the smallest boot. In this manner, a minimum amount of relative movement between the sole of the ski boot and the carrier device occurs when the carrier device pivots.

The carrier device can be made so as to be interchangeable with other carrier devices of different lengths. The length of the carrier device can then be adapted to the kinematic conditions, when using the coupling device for different sizes of ski boots.

In a further embodiment, the projections can be located on the counter holder and the V-shaped recess can be part of the carrier device. This would make it very easy to replace the counter-holders if the projections wear out.

The cog should be longer than the range of vertical adjustment for the toe binding so that it can always engage the guide track. The could would also continue to engage the carrier device even if the toe binding pointed in the vertical direction.

BRIEF DESCRIPTION OF THE DRAWINGS

The above and other objects, advantages and features of this invention will now be described in detail in connection with certain now preferred embodiments thereof, taken in conjunction with the accompanying drawing wherein.

DETAILED DESCRIPTION OF A PREFERRED EMBODIMENT

Figure 1:
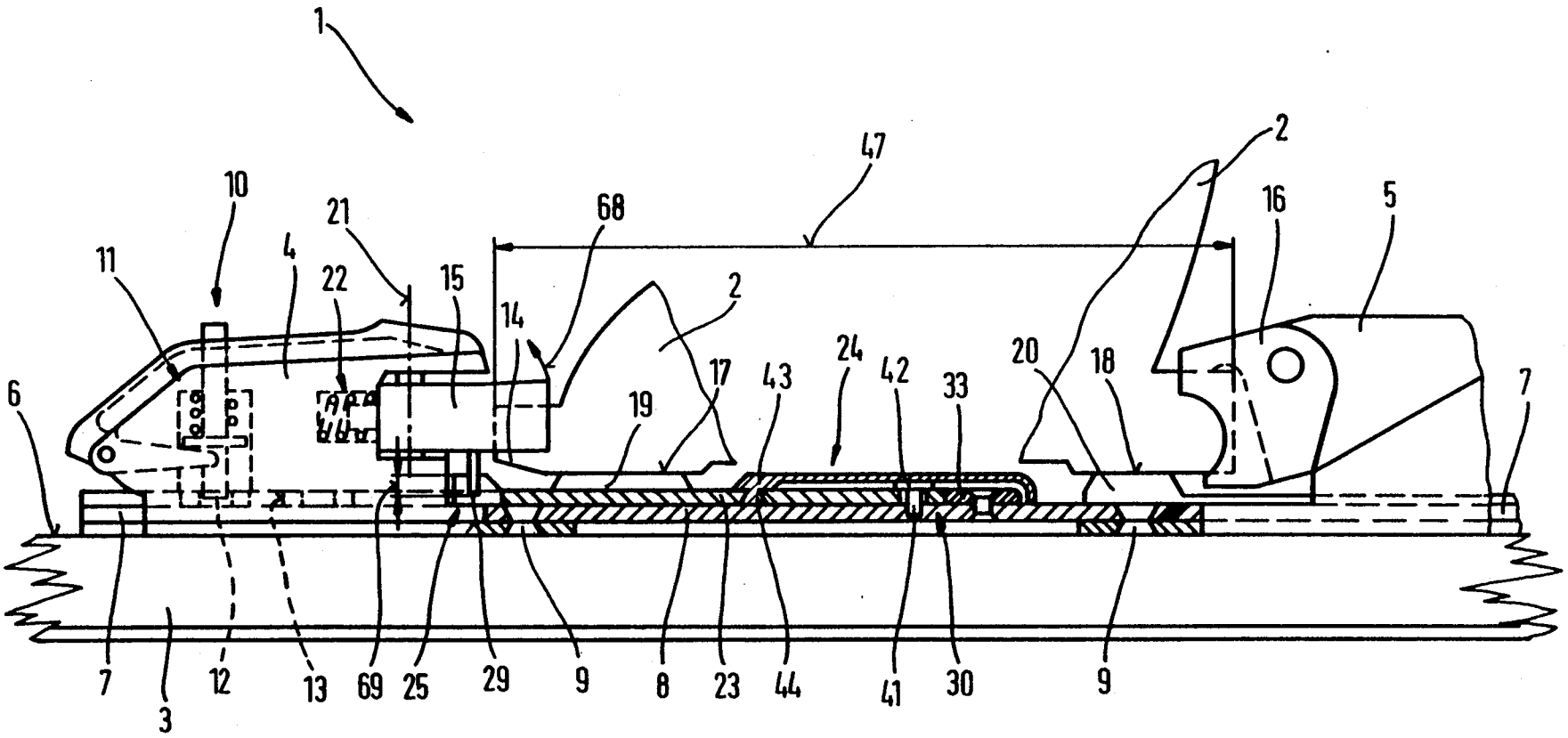
FIG. 1 is a side-elevational view, in part section, of a coupling device embodying the present invention.
Figure 2:
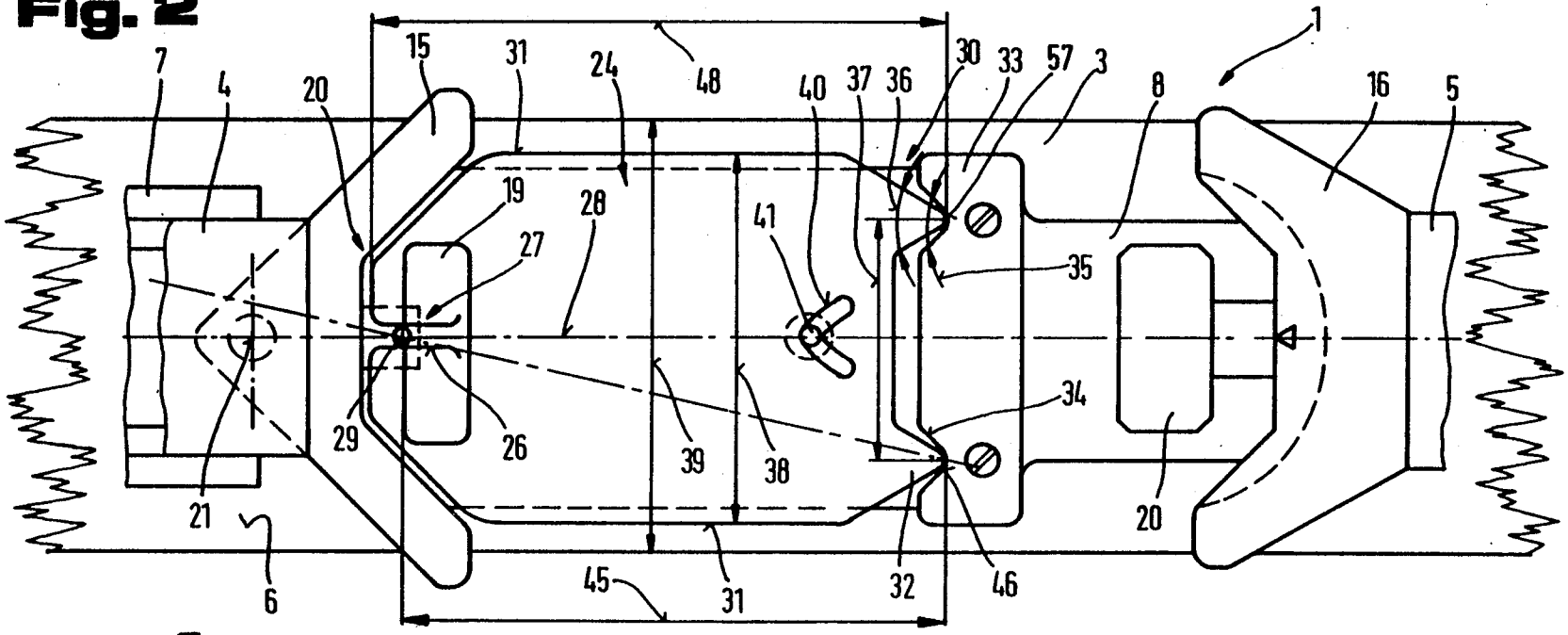
FIG. 2 is a top plan view of the binding shown in FIG. 1 without a ski boot.

Referring now in detail to the drawings and in particular to FIGS. 1 and 2, there is shown a coupling device 1 for holding a ski boot 2 in place on a ski 3. The coupling device 1 is formed by a toe binding 4 and a heel binding 5, which can be moved along longitudinal guides 7, which are attached to a surface 6 of ski 3. Longitudinal guides 7 are formed as C-shaped profiles in the longitudinal direction of ski 3. Toe binding 4 and heel binding 5 are connected via a strip-shaped connection element 8, which is deformable. Connection element 8 can be deformed in the lateral direction of ski 3, as well as in the longitudinal direction between toe and heel bindings 4, 5, but is structured to be rigid, especially to resist tension. Connection element 8 is attached to toe and heel bindings 4, 5 via attachment elements 9.

Toe binding 4 has a locking device 10, e.g. a locking pin 12 which is biased in a locked position by a spiral spring 11 which engages in recesses 13 of longitudinal guide 7. Locking pin 12 can be released from recesses 13 by exerting force to overcome the biasing force of spring 11. Coupling device 1 can then be moved along the longitudinal direction of ski 3. Toe and heel bindings 4, 5 are adjusted simultaneously since they are attached to each other by connection element 8. Ski boot 2 is fixed in place in coupling device 1 in a known manner, via a toe clamp 15 and a heel clamp 16 which clamp sole plates 14 of ski boot 2 against ski 3. Ski boot 2 is clamped against connection element 8 and standing plates 19, 20 which have contact surfaces 17, 18. Toe clamp 15 of toe binding 4 can be pivoted around an axis 21, which is perpendicular to surface 6 of ski 3, in a plane which runs parallel to surface 6. This pivoting action allows ski boot 2 to be released from toe binding 4 and ultimately from coupling device 1 if a sufficient lateral force acts on ski boot 2. In this connection, pivoting of toe clamp 15 can be countered with a predefined resistance by means of an adjustment device 22, indicated schematically.

To avoid friction forces between ski boot 2 and contact surface 17, standing plate 19 is arranged on a carrier device 24 formed by a pivot plate 23. Pivot plate 23 can be pivoted in a plane parallel to surface 6. For this purpose, pivot plate 23 has a longitudinal guide device 27 at an end 25 facing toe binding 4. Longitudinal guide device 27 is formed by a slot 26, which is arranged along a center axis 28 and extends in the longitudinal direction of ski 3. A cog 29 connected with the pivoting toe clamp 15 of toe binding 4 engages with slot 26. Cog 29 transfers the pivoting movement of toe clamp 15 to pivot plate 23 of carrier device 24.

At another end 30 of pivot plate 23, a pair of projections 3 extend in the direction of heel binding 5. Projections 32 are located near side edges 31 of pivot plate 23. Pivot plate 23 is supported in the longitudinal ski direction against a counter-holder 33 which is attached to connection element 8. Counter-holder 33 has approximately V-shaped recesses 34. A cone angle 35 of recesses 34 is greater than a point angle 36 of projections 32. A distance 37 between recesses 34 and projections 32 is approximately 60–80% of a width 38 of pivot plate 34, which is approximately equal to a ski width 39. Pivot plate 23 is secured by a pin 41 which is connected to connecting element 8 and passes through it in a direction vertical to surface 6 of ski 3. Pin 41 resides in a sliding track 40 which is generally in the region of projections 32. Pin 41 has a flanged top 42 which is wider than sliding track 40. Pin 41, sliding track 40 and projections 32 are all covered by a cover 43, preferably formed of plastic, for example, which is attached to the pivot plate 23 via snap connections 44, for example.

It should be stated, in general, that the invention is not limited to coupling device 1, toe binding 4 or heel binding 5 with connection element 8 as shown and described. Any type of toe binding 4 and heel binding 5 with horizontal and/or vertical or diagonal release can be used.

By the use of carrier device 24 structured as pivot plate 23, the relative movement of ski boot 2 on contact surface 17 of standing plate 19 during release of the safety binding is minimized due to pivoting of pivot plate 23. This arrangement avoids friction forces between boot 2 and contact surface 17.

A distance 45 in the longitudinal ski direction between cog 29 and recesses 34 of counter-holder 33 preferably amounts to 60% of a distance 47 between toe and heel bindings 4, 5. The distance between toe and heel bindings 4 and 5 corresponds to the length of ski boot 2. With this distance 45, a minimum relative movement of ski boot 2 with regard to standing plate 19 is achieved in the toe region. Pivot plate 2 of carrier device 24 has a length 48 in the longitudinal ski direction.

Figure 4:
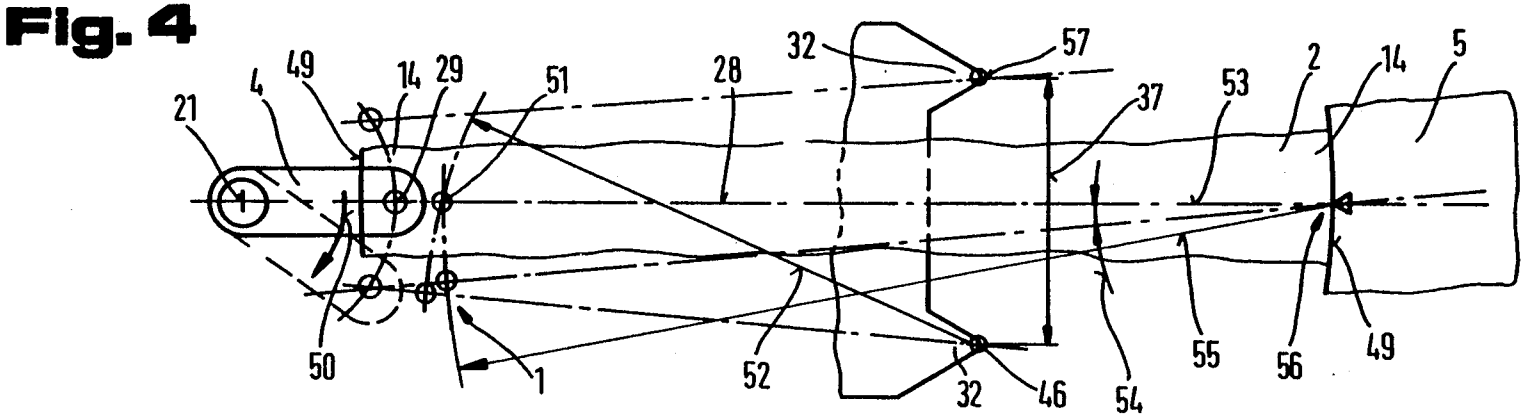
FIG. 4 is a schematic representation of the kinematics of the coupling device, with the carrier device.
Figure 3:
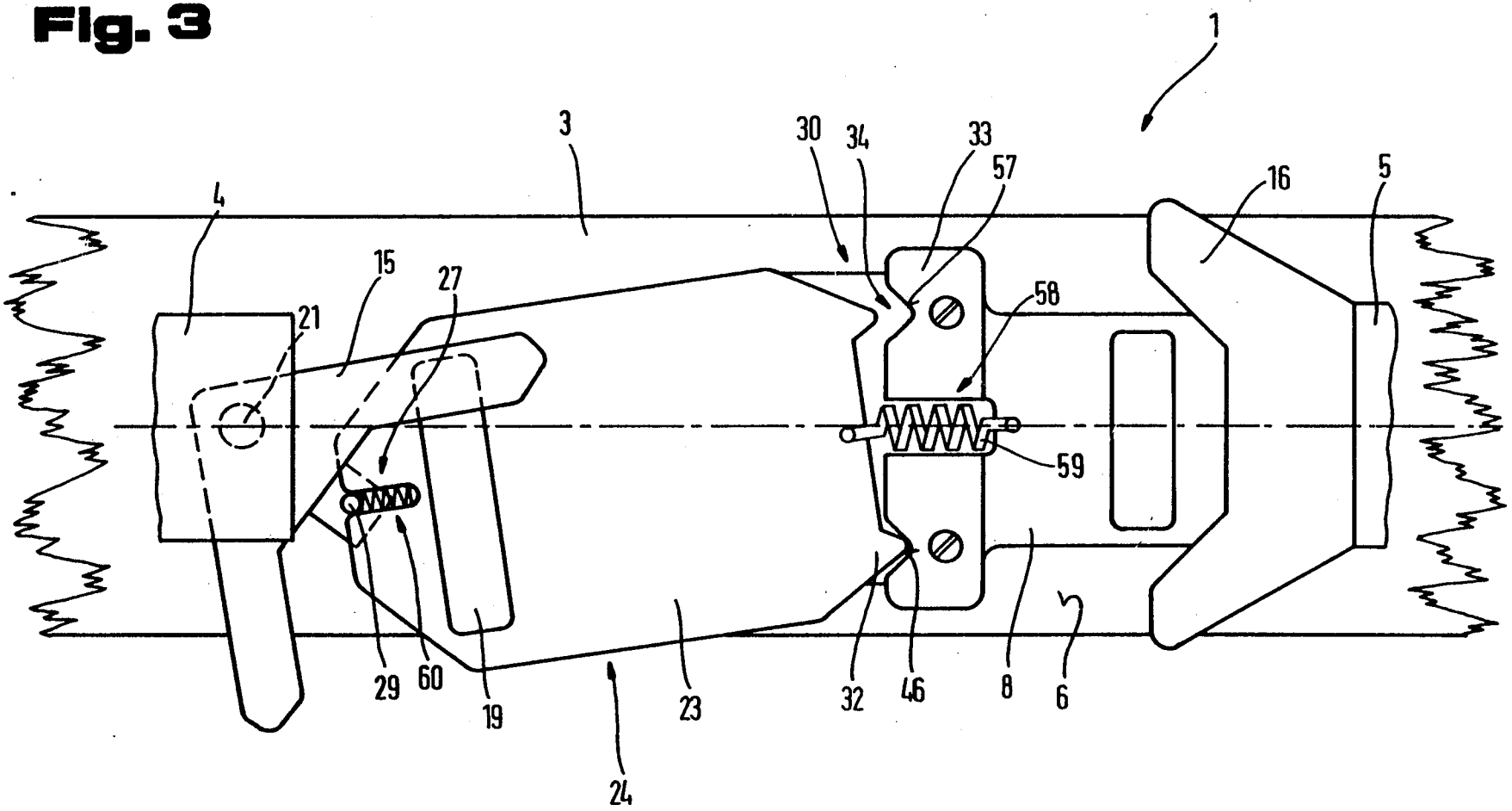
FIG. 3 is a top plan view of an alternate embodiment of the coupling device, shown with the pivot plate pivoted outward.

In FIGS. 3 and 4, coupling device 1 is shown with pivot plate 23 pivoted outward, the kinematics being shown in a simplified representation. Ski boot 2 is clamped in place in its longitudinal direction between toe binding 4 and heel binding 5 and held in place in the vertical direction by a coverage of plates 14 by toe and heel clamp 15, 16. Toe clamp 15 of toe binding 4 can be pivoted around axis 21, arranged to run vertical to the surface 6 of ski 3, parallel to surface 6. Cog 29 extends downward from toe clamp 15 toward surface 6 and can move in the longitudinal direction along guide device 27.

At an end 30 opposite toe binding 4, pivot plate 23 rests against recesses 34 of counter-holder 33 arranged on connection element 8. When toe clamp 15 is pivoted in the direction of an arrow 50, pivot plate 23 is also pivoted around pivot point 46 formed by projection 32 and recess 34. During this pivot movement, a center point 51 of standing plate 14 migrates along an arc with a radius 52 with pivot point 46 as the center point. In this connection, an axis of symmetry 53 of ski boot 2 which runs in the longitudinal direction is pivoted by an angle 54 with reference to center axis 28. This causes a contact point of ski boot 2, resting on standing plate 19, to pivot around a support point 56 at rear end 49 of ski boot 2 and heel binding 5, along an arc with radius 55. When toe clamp 15 is pivoted in the opposite direction, mirror-image pivoting of pivot plate 23 occurs. The other projection 32 separated by distance 37 from opposite projection 32 forms a pivot point 57 with counterpart recess 34. To hold pivot plate 23 in place in the longitudinal direction, and therefore to support projections 32 in the counter-holder 33, a spring element 58 is provided in the embodiment shown in FIG. 3. Spring element 58 may be a tension spring 59, for example, arranged between pivot plate 23 and counter-holder 33, i.e. connection element 8. A pressure spring 60 may be arranged in addition to or instead of spring 58 in guide track 27 between cog 29 and pivot plate 23.

Figure 5:
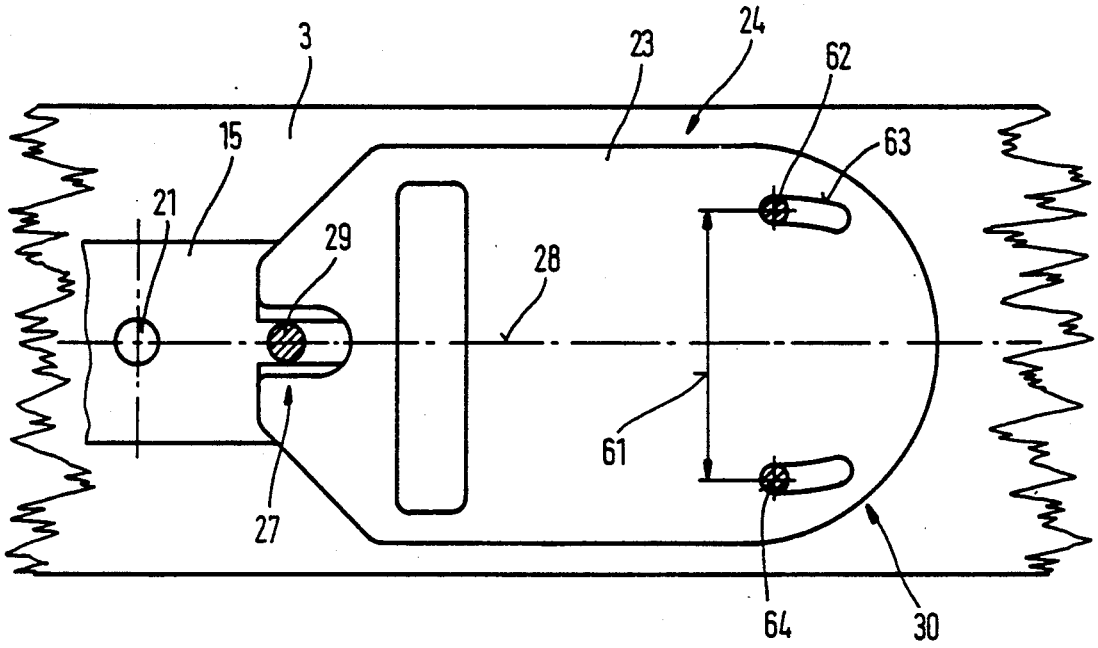
FIG. 5 is a top plan view of another embodiment of the carrier device.

FIG. 5 shows another embodiment of carrier device 24. Toe clamp 15 with cog 29 is arranged on ski 3 to pivot around axis 21. The cog is guided to mov longitudinally in guide track 27 of pivot plate 23. At end 30, two pins 62 are arranged symmetrical to center axis 28 and are separated by a center distance 61. Pins 62 project vertically from surface 6 of ski 3 through circular sliding tracks 63 of pivot plate 23. Sliding tracks 63 extend from sliding blocks 62 toward center axis 28 and end 30 of pivot plate 23. The center point of arcuate sliding track 63 is center point 64 of the opposite sliding block 62 in each case.

Figure 6:
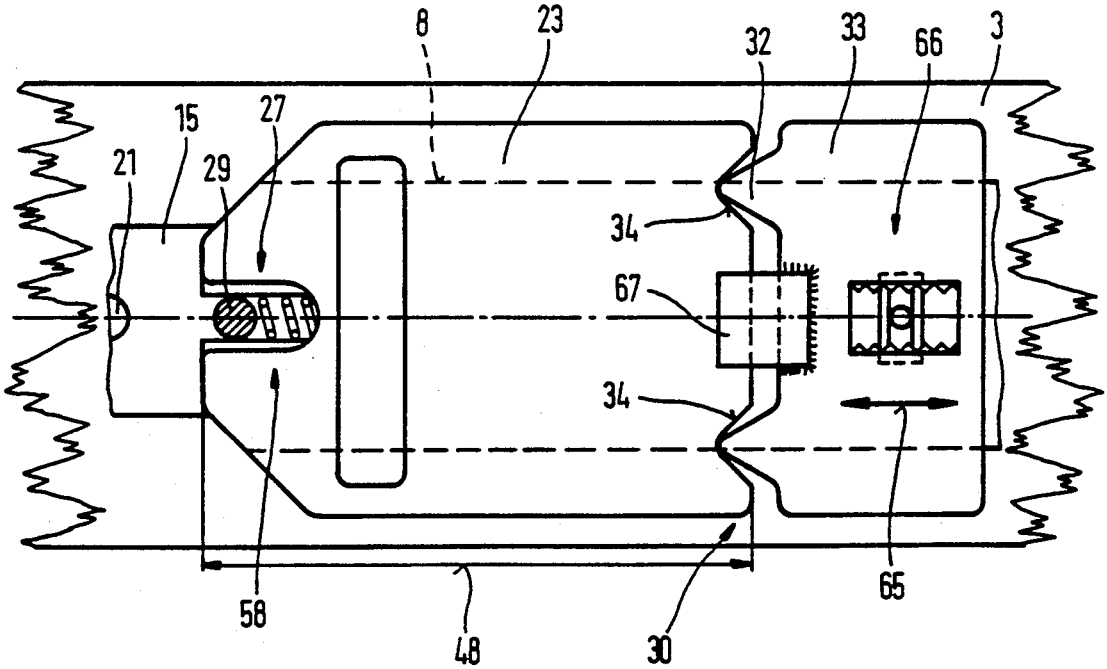
FIG. 6 is a top plan view of a further embodiment of the carrier device.

FIG. 6 shows another embodiment of pivot plate 23 which has recesses 34 at end 30 for finger-like projections 32 arranged on counter-holder 33. Counter-holder 33 is mounted to move along ski 3, i.e. the connection element 8, in the longitudinal direction of ski 3, corresponding to a double arrow 65. Counter-holder 33 can be locked in place in its position relative to ski 3, i.e. connection element 8, by means of a locking device 66. For constant contact of projections 32 in recesses 34, a spring element 58, for example, is arranged in the region of guide track 27 between cog 29 and pivot plate 23. Because counter-holder 33 can be adjusted with reference to its position relative to ski 3, i.e. the connection element 8, pivot plates 23 with different lengths 48 can be used. This may be desirable if ski 3 is used with different sized ski boots 2, for example. Since counter-holder 33 can be adjusted as shown as an example, this embodiment is particularly desirable for rental skis in which coupling device 1 frequently has to be adjusted. To prevent pivot plate 23 from rising off of surface 6 of ski 3, an arm 67 may be arranged on counter-holder 33 which extends over pivot place 23.

With coupling device 1, it is known to adjust toe clamp 15 of toe binding 4 in the vertical direction in order to adapt it to the sole thickness. Toe clamp 15 can also be adjusted to pivot around an axis which runs lateral to the longitudinal ski direction and parallel to surface 6 of ski 3 in accordance with an arrow 68 from FIG. 1. In order to guarantee secure engagement of cog 29 in guide track 27 in such an embodiment, a vertical overlap 69 between cog 29 and guide track 27 is provided which is greater than the vertical deflections of cog 29 in case of a height adjustment or pivoting of toe clamp 15.

For a better understanding of the invention, individual parts were shown distorted and not to proportional scale in the embodiments. Furthermore, individual combinations of characteristics described as a whole in the embodiments can also form independent inventive solutions.

What is claimed is:

1. A coupling device between a ski boot and a longitudinally-extending ski having a top surface, comprising:

a toe binding having first and second sides for engaging the ski boot which is pivotable around a first axis, perpendicular to said top surface of the ski;

a heel binding for engaging the ski boot;

a carrier device with a front end, a back end and two sides located between said toe binding and said heel binding for supporting the ski boot, said carrier device has a length shorter than the distance between said toe binding and said heel binding, said carrier device is pivotable around a second axis and a third axis which are arranged along said back end of said carrier device and are parallel to said first axis, said second and third axes are located on either side of said longitudinal axis an equal distance from said longitudinal axis;

connection means for operatively connecting said first side of said toe binding to said front end of said carrier device so that said carrier device can pivot around one of said second and third axes jointly with said toe binding pivoting around the first axis, said first axis being located on said second side of said toe binding opposite the side connected to said carrier device, said connection means permitting relative movement between said carrier device and said toe clamp in a direction along the longitudinal axis of the ski;

a counter-holder mounted on the ski in the region of said back end of said carrier device; and retaining means attached to the ski for flexibly retaining said carrier device against said counter holder.

2. A coupling device according to claim 1, wherein said carrier device is located adjacent to said toe binding and extends in the direction of said heel binding.

3. A coupling device according to claim 2, wherein said carrier device is pivotally mounted in the region of said two sides.

4. A coupling device according to claim 1, additionally including a pin extending upwardly from the top surface of the ski and passing through a sliding track in said carrier device, so that said pin slides along the track when said carrier device pivots around said second axis and said third axis.

5. A coupling device according to claim 1, wherein said connection means include a guide track located on said front end of said carrier device adjacent to said toe binding.

6. A coupling device according to claim 5, wherein said connection means additionally includes a cog connected to said toe binding which rides along said guide track so that said toe binding and said carrier device can pivot jointly.

7. A coupling device according to claim 1, wherein said connection means includes a cog located on said carrier device which is placed within a guide track arranged on said toe binding, the guide track runs parallel to the longitudinal direction of the coupling device in the non-pivotal stage.

8. A coupling device according to claim 1, wherein said carrier device includes a standing plate which supports the ski boot, said standing plate being formed from a low-friction plastic material.

9. A coupling device according to claim 1, wherein said carrier device extends from said toe binding approximately 60% of the distance toward said heel binding for the smallest ski boot size.

10. A coupling device according to claim 1, wherein said carrier device is an interchangeable carrier device so that different sized carrier devices can be utilized with the coupling device.

11. A coupling device according to claim 1, additionally including a counter-holder located adjacent to said carrier device and between said carrier device and said heel binding having two projections extending toward said toe binding w ich fit within two recesses located on the back end of said carrier

12. A coupling device according to claim 6, wherein said cog is longer than the vertical adjustment range of said toe binding.

13. A coupling device according to claim 1, wherein said retaining means includes a pin attached to the ski and a sliding track disposed within said carrier device, said pin residing in the sliding track to secure said carrier device to the ski.

14. A coupling device according to claim 1, wherein said retaining means comprises a spring coupled between said carrier device and the ski for biasing said carrier device in the direction of the counter-holder.

15. A coupling device according to claim 1, wherein said retaining means comprises two pins attached to the ski and two arcuate sliding tracks disposed withins aid carrier device, said pins projecting vertically from the surface of the ski through the arcuate sliding tracks, with the center point of each arcuate sliding track being the pin projecting through the other arcuate sliding track.

16. A coupling device according to claim 1, wherein said retaining means includes a spring coupled to said front end of said carrier device for biasing said carrier device in the direction of said counter-holder, and an arm extending over said back end of said carrier device to prevent said carrier device from rising off the top surface of the ski.

17. A coupling device according to claim 1, wherein said connecting means comprises a cog connected to said toe binding, and a slot disposed in said front end of said carrier device, said cog engaging the slot to transfer the pivotal action of said toe binding to said carrier device.

18. A coupling device between a ski boot and a ski having a top surface, comprising a toe binding for engaging the ski boot which is pivotable around a first axis, perpendicular to said top surface of the ski;

a heel binding for engaging the ski boot;

a carrier device with a front end, a back end and two sides located between said toe binding and said heel binding for supporting the ski boot and located adjacent to said toe binding and extending in the direction of said heel binding a distance which is less than a distance between said toe binding and said heel binding, said carrier device is pivotable around a second axis and a third axis which are arranged along said back end of said carrier device and are parallel to said first axis, said carrier device is pivotally mounted in the region of said two sides and includes a sliding track;

connection means for operatively connecting said toe binding to said front end of said carrier device so that said carrier device can pivot around one of said second and third axes jointly with said toe binding pivoting around the first axis, said connection means including a guide track located on said front end of said carrier device adjacent to said toe binding; and a cog connected to said toe binding which rides along said guide track so that said toe binding and said carrier device can pivot jointly, wherein said guide track is parallel to the longitudinal direction of the coupling device when said carrier device is in the non-pivoted state.

19. A coupling device between a ski boot and a ski having a top surface, comprising a toe binding for engaging the ski boot which is pivotable around a first axis, perpendicular to said top surface of the ski;

a heel binding for engaging the ski boot;

a carrier device with a front end, a back end and two sides located betwen said toe binding and said heel binding for supporting the ski boot and located adjacent to said toe binding and extending in the direction of said heel binding a distance which is less than a distance between said toe binding and said heel binding, said carrier device is pivotable around a second axis and a third axis which are arranged along said back end of said carrier device and are parallel to said first axis, said carrier device is pivotally mounted in the region of said two sides and includes a sliding track;

connection means for operatively connecting said toe binding to said front end of said carrier device so that said carrier device can pivot around one of said second and third axes jointly with said toe binding pivoting around the first axis;

a pin extending upwardly from the top surface of the ski and passing through the sliding track in said carrier device, so that said pin slides along the track when said carrier device pivots around said second axis and said third axis; and a counter-holder mounted on the ski between said carrier device and said heel binding, wherein said carrier device has pointed projections which extend from the back end of said carrier device towards said counter-holder and said heel binding and which rest against V-shaped recesses set within said counter-holder, the cone angle of the V-shaped recesses is greater than the point angle of the projections.

20. A coupling device according to claim 19, additionally including a connection element which connects said toe binding to said heel binding.

21. A coupling device according to claim 10, wherein said counter-holder and said pin are connected to said connection elements.

22. A coupling device according to claim 21, wherein said counter-holder is attached to said connection element, and said sliding track is formed within said connection element.

23. A coupling device according to claim 19, additionally including a base plate which connectes said counter holder to said toe binding so that said the binding and said counter-holder can be jointly moved to accommodate different size ski boots.

24. A coupling device according to claim 19, additionally including a connection element on which said toe binding, said counter holder and said pin are mounted so that said toe binding, said counter holder arm said pin can be jointly move.

25. A coupling device according to claim 19, additionally including a connection element on which said counter-holder, said sliding track and said toe binding are attached so that said counter-holder, said slidi.ng track and said toe binding can be jointly moved.

26. A coupling device according to claim 23, additionally including a connection element and a locking device, wherein said counter-holder is mounted on said connection element for movement in the longitudinal direction of said coupling device and can be locked in place with said locking device.

27. A coupling device between a ski boot and a ski having a top surface, comprising a toe binding for engaging the ski boot which is pivotable around a first axis, perpendicular to said top surface of the ski;

a heel binding for engaging the ski boot;

a carrier device with a front end, a back end and two sides located between said toe binding and said heel bidning for supporting the ski boot and located adjacent to said toe binding and extending in the direction of said heel binding a distance which is less than a distance between said toe binding and said heel bidning, said carrier device is pivotable around a second axis and a third axis which are arranged along said back end of said carrier device and are parallel to said first axis, said carrier device is pivotally mounted in the region of said two sides and includes a sliding track;

connection means for operatively connecting said toe binding to said front end of said carrier device so that said carrier device can pivot around one of said second and third axes jointly with said toe binding pivoting around the first axis; and a pin extending upwardly from the top surface of the ski and passing through the sliding track in said carrier device, so that said pin slides along the track when said carrier device pivots around said second axis and said third axis, wherein said sliding track extends from a point on the center axis of the carrier device in two directions towards said second and third axes, each part of the sliding track is of arcuate shape with the center point of each arc being one of the second and third axes that the sliding track does not point toward.

28. A coupling device between a ski boot and a ski having a top surface, comprising a toe binding for engaging the ski boot which is pivotable around a first axis, perpendicular to said top surface of the ski;

a heel binding for engaging the ski boot;

a carrier device which a front end, a back end and two sides located between said toe binding and said heel binding for supporting the ski boot, said carrier device is pivotal around a second axis and a third axis which are arranged along said back end of said carrier device and are parallel to said first access, said carrier device including two sliding tracks arranged as mirror image arcuate-shaped tracks on either side of the center axis of the coupling device and two pins attached to the coupling device and extending through the sliding tracks, each pin forming the center point of the opposite arcuate-shaped sliding track; and connection means for operatively connecting said toe binding to said front end of said carrier device so that said carrier device can pivot around one of said second and third axes jointly with said toe binding pivoting around the first axis.

* * * * *